United States Patent [19]

Mueller

[11] 4,366,652

[45] Jan. 4, 1983

[54] PIPE INSTALLATION FITTING

[76] Inventor: Robert H. Mueller, Rte. 2, Box 34, Sheboygan Falls, Wis. 53085

[21] Appl. No.: 219,126

[22] Filed: Dec. 22, 1980

[51] Int. Cl.[3] ..... E04D 13/03; E04B 7/18

[52] U.S. Cl. ..... 52/200; 52/58; 52/199; 285/42

[58] Field of Search ..... 52/200, 58, 199, 95; 285/42; 98/42, 83

[56] References Cited

U.S. PATENT DOCUMENTS

| | | | |
|---|---|---|---|
| 1,326,792 | 12/1919 | Sexauer | 52/200 |
| 2,280,647 | 4/1942 | Hawes | 52/200 |
| 2,345,500 | 3/1944 | Petter | 52/200 |
| 2,956,495 | 10/1960 | Sublette | 52/58 X |
| 3,521,414 | 7/1970 | Malissa | 52/200 X |
| 3,742,659 | 7/1973 | Drew | 52/199 X |
| 3,802,131 | 4/1974 | Resech | 52/200 X |
| 4,102,090 | 7/1978 | Anguish | 52/58 |

FOREIGN PATENT DOCUMENTS

| | | | |
|---|---|---|---|
| 1904754 | 8/1970 | Fed. Rep. of Germany | 52/200 |
| 2407254 | 8/1975 | Fed. Rep. of Germany | 52/200 |
| 426808 | 11/1947 | Italy | 52/200 |
| 678166 | 8/1979 | U.S.S.R. | 52/199 |

*Primary Examiner*—J. Karl Bell

*Attorney, Agent, or Firm*—Wheeler, House, Fuller & Hohenfeldt

[57] ABSTRACT

Pipe installation fitting for sealing around a pipe or conduit where it passes through the roof or outside wall of an enclosed structure. Conduits pass substantially vertically through the base panel of the hood, make a right angle bend, then pass through a vertically disposed panel. More than one pipe or other protruding structure may be installed in a single flashing hood.

The flashing hood of the present invention is easy to use, can be quickly installed, provides thermal, vibration, and moisture insulation, and can be reopened at any time for servicing, replacing, or adding to conduits passing through it.

11 Claims, 3 Drawing Figures

PIPE INSTALLATION FITTING

TECHNICAL FIELD

The present invention is a structure to replace flashing for sealing around a pipe, conduit or the like where it passes through the roof or outside wall of an enclosed structure.

BACKGROUND ART

The use of flashing to seal around pipes, conduits, wires, chimneys or other structures protruding through a roof or wall of a building is well known. (Such protruding structures will be referred to generically as conduits herein.) Conventional flashing is a sheet metal collar which fits around the conduit to prevent air and water from passing through the roof along the outside of the conduit.

Conventional flashing has several disadvantages. First, it is difficult to adequately seal around a conduit, particularly a small one, using conventional flashing. Second, when several conduits pass through a roof at one point, separate flashing and holes must be provided for each conduit to insure proper sealing. Thus, installation of flashing around a multitude of conduits on a roof is a custom operation which requires much time and expense.

In addition, flashing typically is made of metal, and when a conduit passing through the roof is subject to vibration, the vibration caused metal to metal contact between the flashing and conduit. Conventional flashing also does not provide thermal insulation to prevent heat transfer through the roof.

Conventional flashing thus does not provide easy and fast installation and a vibration proof, thermally insulated structure.

SUMMARY OF THE INVENTION

The present invention is a pipe installation fitting which can aptly be described as a flashing hood. The flashing hood is particularly adapted to be positioned on a roof curb or like structure which has upstanding flanges framing a roof opening sized to accommodate any number of conduits.

When the flashing hood and conduits are installed, the conduits pass substantially vertically through the base panel of the hood, make a right angle bend, then pass through the vertically disposed panel. More than one pipe or other protruding structure may be installed in a single flashing hood, so one such hood takes the place of many individual installations of flashing according to the known technique.

The flashing hood of the present invention is easy to use, can be quickly installed, proved thermal and vibration insulation, prevents leakage of precipitation into the building, and allows additional conduits to be installed later without the need to provide additional flashing.

BRIEF DESCRIPTION OF DRAWINGS

FIG. 3 also shows the hood installed on a curb which frames an opening in a roof.

DESCRIPTION OF THE INVENTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
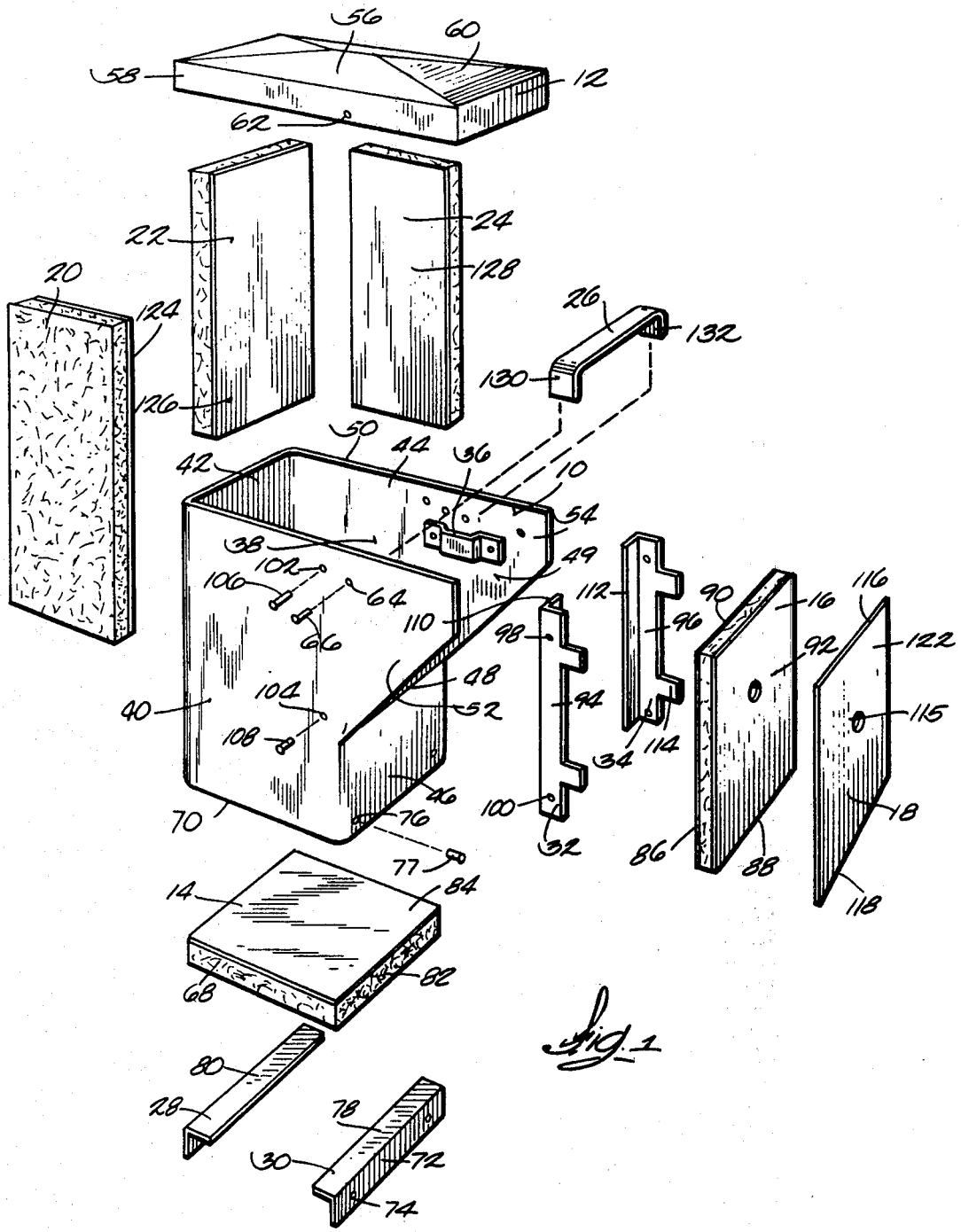
FIG. 1 is an exploded perspective view of the parts of a flashing hood according to the present invention.

Referring first to FIG. 1, the flashing hood of the present invention generally comprises a housing 10, a cover 12, a base panel 14, a vertically disposed panel 16, a sealing sheet 18, insulation panels 20, 22, and 24, a rigid horizontal member 26, angle brackets 28, 30, 32 and 34, and horizontal member receiving brackets 36 and 38 (38 is not shown).

Housing 10 comprises vertical side walls 40, 42, 44 and 46, preferably formed of sheet metal bent and joined to form a unitary structure with air and moisture resistant joints. Vertical side wall 46 has an upper margin 48 which is substantially below the upper margin 50 of housing 10. Upper margin 48 thus defines the lowest extremity of an opening 49 in housing 10 which is flanked by flange extensions 52 and 54. In this embodiment of the invention flange extensions 52 and 54 are extensions of vertical side walls 40 and 44, although it will be understood that flange extensions 52 and 54 are not necessarily coplanar with vertical side walls 40 and 44. In a preferred embodiment of the invention, flange extensions 52 and 54 are substantially perpendicular to the vertical side wall 46 in which opening 49 is formed.

Figure 2:
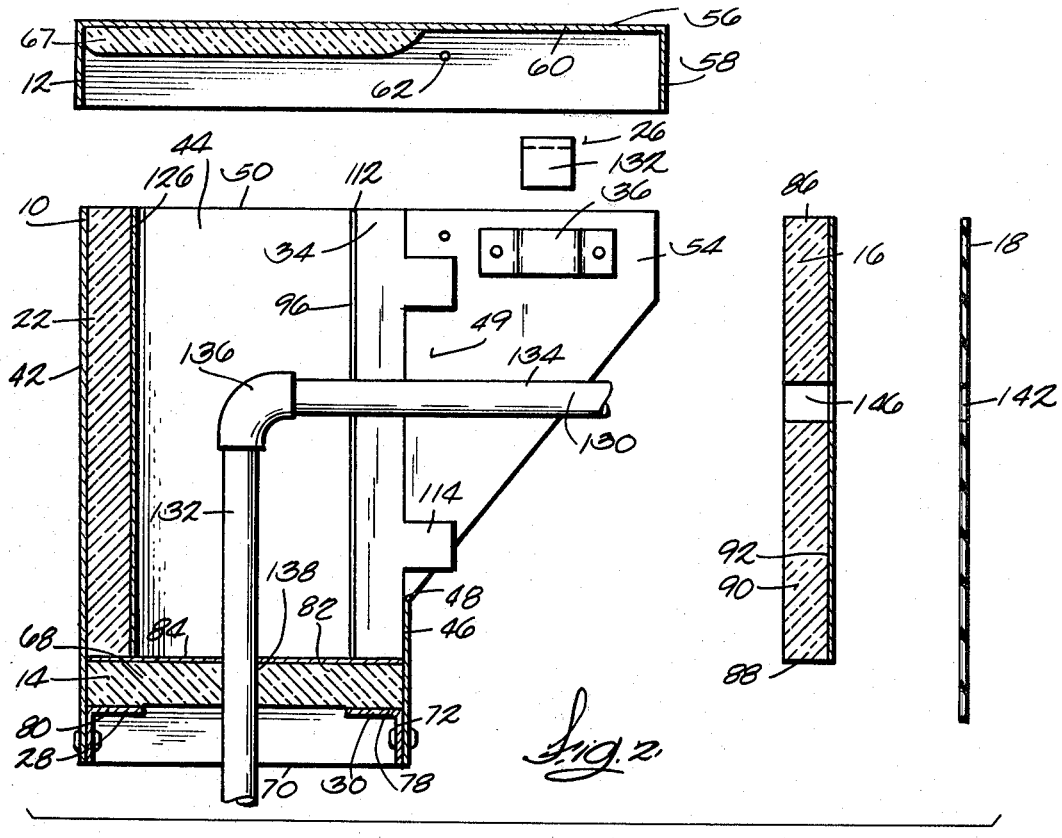
FIG. 2 is a cut away side view of the flashing hood of FIG. 1, shown partially disassembled with a conduit in place.

Cover 12 has a central portion 56 which is preferably peaked for strength and to prevent water from accumulating on it. Around central portion 56 is a depending skirt 58 which fits outside of vertical walls 40, 42 and 44 and flange extensions 52 and 54. In a preferred mode of the invention, a sliding fit is provided between skirt 58 and the upper margin 50 of the housing. Cover 12 is positioned on housing 10, and overhang portion 60 of cover 12 spans between the upper margins of flange extensions 52 and 54. Thus, flange extensions 52 and 54 and overhang portion 60 shield opening 49 from the elements. Holes such as 62 in cover 12 are positioned to be in registration with holes such as 64 in the vertical side walls of housing 10 to allow the insertion of screws, rivets or the like to fasten cover 12 in place. The fastening devices used to secure cover 12 to housing 10 are preferably provided with neoprene washers or other sealing means. In a preferred mode of the invention sheet metal screws such as 66 are used to secure cover 12 removably in place. An insulating panel 67 can be provided within cover 12; this is shown in FIG. 2.

Base panel 14 has a perimeter 68 which closely fits within the inner perimeter of housing 10 just above its lower margin 70 in order to obstruct the open bottom of housing 10. Base panel 14 is supported within housing 10 by brackets 28 and 30, each comprising a vertical portion such as 72 provided with holes such as 74 which are positioned within the housing in registration with holes such as 76 to receive fasteners such as 77 to secure vertical portion 72 within the housing. Brackets 30 and 28 further comprise horizontal portions 78 and 80 which are mutually coplanar, parallel to the plane of lower margin 70, and perpendicular to vertical side walls 42 and 46 when brackets 28 and 30 are in place. Horizontal portions 78 and 80 support base panel 14 within housing 10, and also support the completed flashing hood on a curb or similar structure, as will be further explained below. Base panel 14 preferably comprises a batt of fairly rigid insulating material 82 having a foil inside facing 84 providing a vapor and radiation barrier.

Vertically disposed panel 16 has a perimeter 86 with side edges which fit snugly between vertical side walls 40 and 44 and a top edge which fits snugly against cover 12 to insulate and obstruct the opening 49 in housing 10 when vertically disposed panel 16 is mounted in housing 10. Panel 16 also has a lower edge 88 which is positioned adjacent upper margin 48 of vertical side wall 46 to complete the closure of opening 49. Panel 16 is preferably composed of a batt 90 of fairly rigid insulating material having a foil facing 92.

Panel 16 is held in place by brackets 32 and 34, respectively having vertical wall engaging portions 94 and 96 provided with holes such as 98 and 100 normally in registration with holes such as 102 and 104 in vertical side wall 40. This arrangement allows the fastening of vertical wall engaging portions 94 and 96 to vertical walls 40 and 44 within housing 10 using fasteners such as 106 and 108, which are also provided with means to prevent air and water from entering housing 10. Perpendicular flange portions such as 110 and 112 of brackets 32 and 34 are coplanar, and extend vertically within housing 10. To fix vertically disposed panel 16 within housing 10, the brackets 32 and 34 are secured within housing 10, panel 16 is placed against flange portions 110 and 112, and tabs such as 114, which are extensions of brackets 32 and 34, are folded against facing 92 of panel 16 to secure panel 16 in place. Panel 16 may be removed if necessary by unbending the tabs such as 114 to release the panel. In a preferred mode of the invention panel 16 is somewhat compressible to allow tabs such as 114 to grip panel 16.

Sheet 18 is a sheet of waterproof material, preferably a tacky material which is sufficiently pliable to be worked by hand. Sheet 18 has a central portion 115 which is adhered to vertically disposed panel 16 when the flashing hood is assembled. Upper margin 116, lower margin 118, and side margins 120 and 122 of sheet 18 extend beyond the corresponding edges of panel 16 and respectively engage the cover 12, the outside of vertical side wall 46 adjacent its upper margin 48, and inside portions of flange extensions 52 and 54 to positively seal the opening 49 in the housing.

Insulation panels 20, 22 and 24 are panels of insulation faced with foil layers 124, 126 and 128 and attached to vertical walls 40, 42 and 44. Panel 20 extends vertically between base panel 14 and upper margin. 50 of the housing, and extends laterally between insulation panel 22 and perpendicular flange portion 110 of bracket 32. Insulation panel 22 has a vertical extent similar to that of insulation panel 20, and extends horizontally between vertical side walls 40 and 44 of housing 10. Insulation panel 24 has the same vertical extent as panels 20 and 22, and extends horizontally between insulation panel 22 and perpendicular flange portion 112 of bracket 34. Loose insulation (not shown) may also be used to fill the space enclosed by panels 14, 16, 20, 22 and 24 to provide additional thermal and mechanical insulation.

A rigid horizontal member 26 is optionally provided in order to provide a removable structure to stiffen flange extensions 52 and 54. Member 26 has downturned end portions 130 and 132 which are inserted vertically downward into brackets 36 and 38 to secure member 26 removably in place to span between flange extensions 52 and 54.

Referring now to FIG. 2, a flashing hood is shown disassembled only to the extent necessary to install conduit 130 within it. Conduit 130 installed in the flashing hood comprises a vertical run 132 and a horizontal run 134 joined by an elbow 136 which may be an integral part of the conduit.

A hole 138 is formed in base panel 14 to accomodate vertical run 132 of conduit 130. Similarly, holes 140 and 142 are formed in vertically disposed panel 16 and sealing sheet 18 to accommodate horizontal run 134 of conduit 130. After holes 138, 140 and 142 have been formed, conduit 130 is thrust through hole 138, while base panel 14 is in place, until horizontal run 134 is just above its final position between brackets 32 and 34. Panel 16 and conduit 130 are then slid downward until horizontal run 134 is in its final position. Tabs such as 114 are bent inward to hold panel 16 in place. Finally, sealing sheet 18 is slid along horizontal run 134 until sheet 18 is positioned against panel 16, the insides of horizontal flange extensions 52 and 54, and the outer surface of vertical side wall 46. At this point the periphery of hole 142 in sealing sheet 18 is also sealed against conduit 130 to prevent water from running along conduit 130 and into housing 10. Member 26 is then installed in brackets 36 and 38. Finally, cover 12 is placed on housing 10 and secured in place after a loose batt of insulation is inserted in the housing.

Figure 3:
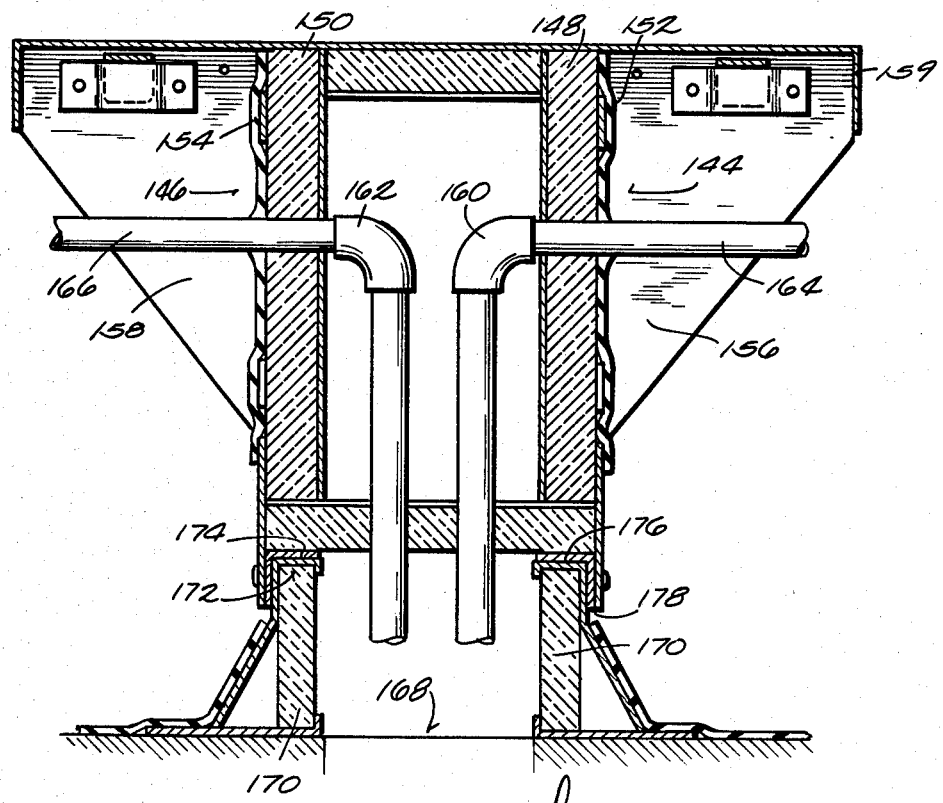
FIG. 3 is a cut away side view of an alternate embodiment of the invention providing means to route conduits in plural directions from a single flashing hood.

FIG. 3 shows an alternate embodiment of the invention wherein a housing is formed with plural openings 144 and 146 provided with vertically disposed panels 148, 150; sealing sheets 152, 154; and pairs of flanking flange extensions such as 156 and 158. Cover 159 overhangs each pair of flange extensions. In FIG. 3, plural conduits 160, 162 can be provided and mounted with their respective horizontal runs 164, 166 extending in different directions. It will be appreciated, however, that more than one conduit or like structure could be routed through each base panel and vertically disposed panel in FIGS. 2 and 3, so the structure of FIG. 3 is only needed when conduits are to be routed in different directions from a common opening in the roof.

FIG. 3 also illustrates the installation of a flashing hood according to any embodiment of the invention over an opening in a roof or like structure. In FIG. 3, an opening 168 in a roof is framed by a curb 170 shown in section in FIG. 3. Curb 170 has an upper margin 172 which supports brackets 174 and 176 (corresponding to brackets 28 and 30 in FIG. 1). The lower margin 178 thus encircles and extends below upper margin 172 of curb 170 to provide a junction which is secure against the entry of water and air.

I claim:

1. A flashing hood comprising:

(A) a housing having an open bottom, an open top, vertical side walls, an opening in an upper portion of one of said side walls, and paired flange extensions flanking each side of said opening;

(B) a removable cover for said housing which overlies said flange extensions;

(C) a base panel fixed within said housing below said opening to obstruct said open bottom;

(D) a vertically disposed removable panel fixed within said housing to block said opening; and (E) insulating means within said housing and cover to prevent heat and air transfer to and from the inside of said flashing hood.

2. The flasing hood of claim 1, wherein said base panel and said front panel each are composed of thermal insulation.

3. The flashing hood of claim 1, wherein said front panel is removably attached to said side walls by first and second bracket means.

4. The flashing hood of claim 1, wherein the inside surfaces of said side and rear walls of said housing are lined with panels of insulating material extending vertically form said base panel to an upper extremity adjacent the top of said housing.

5. The flashing hood of claim 4, wherein the portion of the inside of said cover normally positioned above the inside of said housing is lined with a panel of insulating material.

6. The flashing hood of claim 1, further comprising a sealing sheet having a central portion which is attached to the outside of said front panel, a lower marginal portion which is attached in sealing relation to at least an upper outside portion of the front wall of said housing, and side marginal portions which are attached in sealing relation to inside portions of said flange extensions adjacent said front panel.

7. The flashing hood of claim 6, wherein said sealing sheet further comprises an upper marginal portion which is attached in sealing relation to the inside of said cover.

8. The flashing hood of claim 6, wherein said sealing sheet is tacky and self-adherent to said front panel, front wall, flange extensions and cover.

9. The flashing hood of claim 1, further comprising a rigid horizontal member spanning between the inside surfaces of said flange extensions.

10. The flashing of claim 9, wherein said horizontal member removably engages bracket means fixed to said flange extensions.

11. The flashing hood of claim 1, further comprising plural openings in upper portions of said vertical side walls, paired flange extensions flanking each side of each said opening, and a vertically disposed removable panel and sealing sheet blocking each said opening.

* * * * *

UNITED STATES PATENT AND TRADEMARK OFFICE

CERTIFICATE OF CORRECTION

PATENT NO. : 4,366,652

DATED : January 4, 1983

INVENTOR(S) : Robert H. Mueller

It is certified that error appears in the above—identified patent and that said Letters Patent is hereby corrected as shown below:

Column 5, Claim 2, Line 4, "flasing" should read --flashing--

Column 5 Claim 4, Line 13, "form" should read --from--

Column 6, Claim 10, Line 14, "The flashing of Claim 9" should read --The flashing hood of Claim 9--

Signed and Sealed this

*Fifteenth* Day of *March 1983*

[SEAL]

*Attest:*

GERALD J. MOSSINGHOFF

*Attesting Officer*

*Commissioner of Patents and Trademarks*